United States Patent [19]

Michelson, deceased

[11] Patent Number: 4,844,844

[45] Date of Patent: Jul. 4, 1989

[54] LIQUID SEAL SYSTEM FOR MINIMIZING FLOW PULSING IN FLARE SEAL DRUMS

[76] Inventor: Herbet D. Michelson, deceased, late of Fort Lee, N.J. by Robert M. Levy, 141 E. 88th St., New York, N.Y. 10028, executor

[21] Appl. No.: 186,816

[22] Filed: Apr. 27, 1988

[51] Int. Cl.[4] ..... B01F 3/04

[52] U.S. Cl. ..... 261/62; 137/251.1; 261/65; 261/121.1

[58] Field of Search ..... 261/62, 65, 121.1, 119.1, 261/122–124, 120; 137/251.1, 254

[56] References Cited

U.S. PATENT DOCUMENTS

| | | | |
|---|---|---|---|
| 948,432 | 2/1910 | Rudeen | 261/62 |
| 1,064,984 | 6/1913 | Murray et al. | 261/119.1 X |
| 2,625,383 | 1/1953 | Baird | 261/119.1 |
| 3,064,956 | 11/1962 | Reed | 261/124 |
| 3,231,252 | 1/1966 | Reed | 261/124 X |
| 3,595,260 | 7/1971 | Lotzmann et al. | 137/251.1 |
| 3,606,985 | 9/1971 | Reed | 261/123 X |
| 3,691,730 | 9/1972 | Hickey et al. | 261/121.1 X |
| 3,794,303 | 2/1974 | Hirshon | 261/120 X |
| 4,288,396 | 9/1981 | Ottestad | 261/65 X |

*Primary Examiner*—Richard L. Chiesa
*Attorney, Agent, or Firm*—Klauber & Jackson

[57] ABSTRACT

An improvement is disclosed for a flare seal system of the type which includes a flare seal drum containing a body of liquid at a predetermined level and a waste gas inlet conduit extending vertically into the liquid body and having an opening beneath the liquid level, whereby gases discharging from the inlet conduit pass through the liquid body before discharging from the drum to a flare stack. The improvement enables the reduction of gas pulsing from the seal drum, and includes flap valve means pivotally mounted at the wall of the inlet conduit. The flap valve is openable at a point beneath the liquid level, and includes means to bias the valve to a closed position. The inlet gas flow pressure acts against the bias to open the valve, to enable gas flow into the liquid and thence to the flare stack.

6 Claims, 3 Drawing Sheets

LIQUID SEAL SYSTEM FOR MINIMIZING FLOW PULSING IN FLARE SEAL DRUMS

FIELD OF THE INVENTION

This invention relates to a liquid seal system, particularly suited, though not exclusively, for a flare.

BACKGROUND OF THE INVENTION

Flare and vent stacks are commonly used in the petroleum, chemical and petrochemical industry to dispose of combustible gases which either constitute waste material or which have had to be released to relieve excess pressure. These stacks are frequently provided with a liquid seal through which the gases pass. The purpose of the liquid seal includes the preventing of flame flashback, and the maintenance of an above-atmospheric pressure in the feedline leading to the stack. An above-atmospheric pressure is needed to prevent any possibility of air entering the feedline through faulty connections or the For very large rates of gas flow, a horizontal vessel sometimes referred to as a "flare seal drum" is used, and is conventionally mounted alongside the stack to perform these functions.

In more detail, flaring apparatus is thus employed for flaring combustible gaseous materials, nd especially for the flaring and burning of gaseous hydrocarbon material where such materials are derived from operations for the refining of petroleum oils in various industrial operations, in which large volumes of combustible gaseous materials are produced. As is apparent, some of these materials have no real economic value as fuel or otherwise, and therefore must be disposed of in a suitable manner. Further, such materials result from upset conditions in the normal operation of a refinery wherein gases which ordinarily might be subjected to further processing in order to obtain valuable products therefrom must be vented in order to avoid the occurrence of dangerously abnormal pressures in operating equipment. The total volume of all such accumulations of gases in normal refinery operation and their hazardous nature make it impracticable for such gases to be discharged directly into the atmosphere. Thus, in practice, it is customary to burn such gases as they are discharged from an exhaust or flare stack at a considerable distance above the ground, although on occasion for the sake of economy, burning may be accomplished in relatively low large diameter enclosures or flare structures. The flare seal drum fits into the overall flaring apparatus in that it, as mentioned, prevents flashback, that is, it prevents a backfeed of the flame. Further, by preventing any backfeed of air the possibility of combustion is substantially eliminated, and thus an explosive situation is avoided.

The flare systems thus commonly installed at refineries and petrochemical plants, must be capable of smoothly carrying off the sudden waste gas surges occurring during operating disturbances and in emergencies. A flare system of the type described, generally consists of a collecting or inlet line in which the gases to be flared are passed by way of a liquid-containing drum connected to the flare which is designed as a high stack and/or as a ground level flare and from which the gases can be flared in so far as they are combustible. The liquid used may be water or, if required a glycol/water mixture.

For example, it is known to provide apparatus which has been referred to as a "water seal pot", which allows gases to flow through the water when the pressure in the supply line upstream of the water seal pot is greater than that which will displace the head of water above the point at which the gas is released. One of such known devices includes a tube which guides the gas into a vessel, the tube having an open end immersed in the liquid retained in the vessel. The gas, when supplied at pressures greater than those required to displace the head of water above the open free end of the tube, moves through the liquid. The flow of gas is not constant and the gaseous medium is discharged in the form of large bubbles. The bubbles of compressible gas within an incompressible liquid set up pressure surges both upstream and downstream of the seal pot. It is possible for these surges to vary sufficiently to cause instantaneous interruption of the flow of gases downstream of the water pot. Thus, for example, when a water seal pot of the type employed in the past is arranged in the gas supply line to a flare stack gas burner, the interruption in the flow of gases often causes a rapid extinction of the flame with corresponding rapid reignition, which cause the repeating of an objectionable "boom" upon each reignition of the gaseous medium.

Conventional designs of liquid-seal units used practice have serious disadvantages, e.g.:

The immersion liquid is affected during the whole period of the flaring operation by the quantity or pressure of gas involved. Excess pressures cause a liquid funnel (cone) to be formed.

The liquid funnel which is formed collapses again and again, and this gives rise to pulsation, causes an upsurge in the gas column in the flare and produces the familiar of a pulsatingly burning flare; this has the effect of increasing the noise level.

Serious problems arise in the operation of seal drums as a result of a pulsing flow of gas. The pulsing flow has a tendency to cause the flare to go out, and then to be reignited, as mentioned, and a resulting booming sound which is objectionable. Furthermore, increased smoking at the flare may occur, and this requires the injection of additional amounts of steam into the flame. Not only is this wasteful of energy, but it results in a rumbling sound which is rather loud and, like the booming, is disturbing to the neighborhood. From the standpoint of efficiency, economy and public relations, therefore, it is important to eliminate, or at least to suppress, gas pressure surges to the flare Many prior devices have been proposed for this purpose and, while they are to some degree effective, these prior devices fall short of successfully solving the problem.

Typical of proposals of this type generally involve systems for distributing the gas through a plurality of open outlets or ports. Typical constructions are shown, for example, in Reed U.S. Pat. Nos. 3,064,956, 3,231,252, and 3,606,985, and in U.S. Pat. No. 3,595,260.

It is, accordingly, an object of the present invention to provide a seal drum construction for a flare which effectively suppresses the heretofore encountered negative effects of pulsing flow.

It is another object of the invention to provide a flare seal drum of the character indicated wherein any variations pressure in the incoming gas flow are effectively accommodated, and pulsing flow to the flare is minimized.

It is a still further object of the invention to provide a flare seal drum construction of the character indicated, wherein the pulsing-suppressing action occurs automatically at all times, and does not require the intervention of an operator.

BRIEF DESCRIPTION OF THE DRAWINGS

The above and other objects of the invention, will be readily apparent from the following detailed the invention, taken in combination with the accompanying drawings, wherein.

DESCRIPTION OF PREFERRED EMBODIMENT

Figure 1:
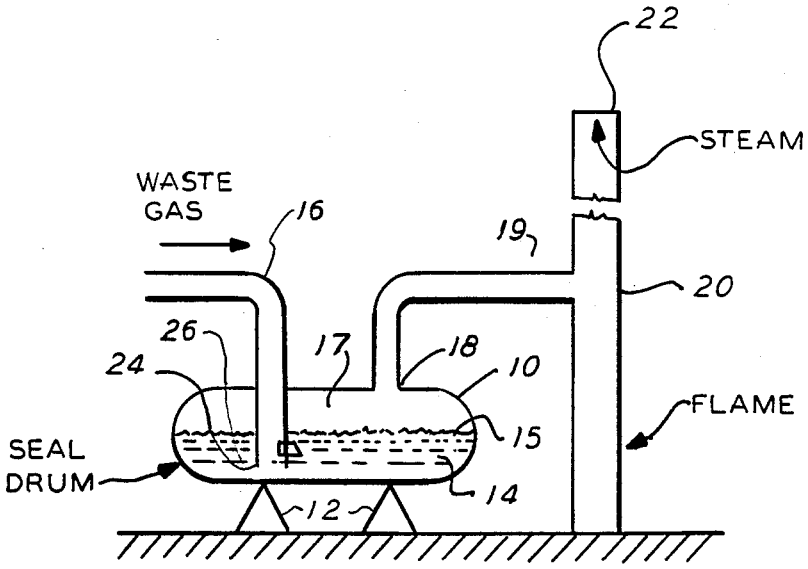
FIG. 1 is a diagrammatic side elevational view of a flare and seal drum construction embodying features of the present invention.

Referring now to the drawings, and particularly to FIG. 1, a seal drum 10 is suitably supported on bases 12. The seal drum 10 is constructed to contain a body of liquid 14 having a level 15, which is approximately at the longitudinal axis of the drum. The liquid 14 at level 15 leaves a gas flow space 17 in the upper portion of drum 10. A gas inlet conduit for waste gas to be flared, extends into drum 10 and is indicated at 16, and a gas-outlet conduit extending from an opening 18 in the upper portion of drum 10 is shown at 19. Conduit 19 communicates with a flare stack 20 for flaring the waste gas at its upper end 22. The flare stack 20 is provided at its upper end 22 with the usual igniting mechanism (not shown), and is provided with means (not shown) for supplying steam to suppress smoke formation.

The gas inlet conduit 16 extends toward the bottom of drum 10 so that it will be immersed in the liquid 14 contained in the drum to a point below liquid level 15 when the seal drum is in operation. The gas-inlet conduit 16 is open at its lower end as shown at 24. The liquid within conduit 16 will be depressed by the gas pressure within the conduit, to a level 26 which is a function of the said gas pressure in conduit 16, and in space 17.

Figure 2:
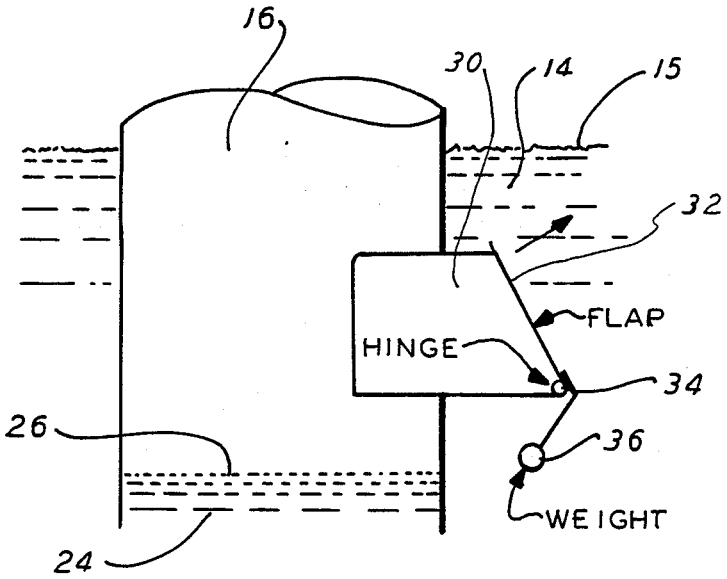
FIG. 2 is a detailed side elevational view of the construction of the lower end of the gas inlet conduit, in a preferred embodiment of the invention.
Figure 3:
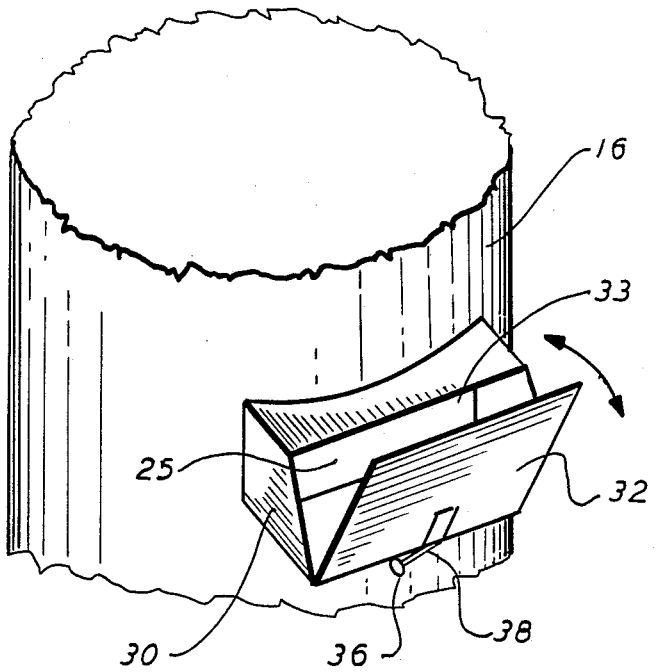
FIG. 3 is a perspective view of the embodiment illustrated in FIG. 2.

In accordance with the invention, the lower end of the gas-inlet conduit or "dip pipe" 16; i.e. the portion of the conduit which normally lies below the level 15 of the liquid 14 contained in the drum 10, is provided with a biased valve means which functions for releasing gases into the liquid body at pre- determined gas pressure levels. For this purpose, and as best seen in FIGS. 2 and 3, the conduit 16 is formed with a lateral opening 25 into which a housing 30 is sealed, which is provided with a closure in the form of a hinged flap or door 32, which is biased to a closed position, and which defines what is, in effect, a flap valve. Preferably, the flap 32 is hinged, as at its lower end, as shown at 34 so that the valve opening 33 created by pivotal movement of flap 32 away from housing 30, faces upwardly toward the surface of liquid 14, so as to permit a relatively unimpeded flow of gas.

Biasing may be effected by any convenient means, but preferably the means takes the form of a weight 36 which is attached to an arm 38 which extends obliquely downward toward the body of conduit 16 and supports weight 36 at its free end, and has its other end connected to the lower end of flap 32. This construction is clearly illustrated in FIG. 2. It has the advantage of limiting the degree of opening of the extension 30, by reason of outward tilting of flap 32 since the weight 36 will strike the lower portion of housing 30 when the flap is at its maximum open position. The biasing weight 36, however, will effectively return the flap 32 to its closed position when the excess pressure of the gases flowing into conduit 16 has subsided. Further consideration of the arrangement of FIG. 2, will show that in fact the restoring force of the biasing means increases with the opening of the flap valve. This follows in that the weight 36 is movable with the flap portion 32 of the valve means; and weight 36 has a lever arm with respect to the axis 34 of pivot of the flap, which increases with the opening of the flap, thereby creating an increasing restoring force as the size of the opening increases.

Spring means (not shown) can also be employed for biasing purposes, although the weighted biasing just described is preferred since springs may be susceptible to corrosion or other types of deterioration. For example, a spring or elastic can be attached between the end of the upper portion of housing 30 and the upper end of flap 32 to hold the flap 32 in closed position during normal pressure operation. Biasing means can be readily selected to permit opening of flap 32 at any desired gas pressure exerted against it.

Figure 2A:
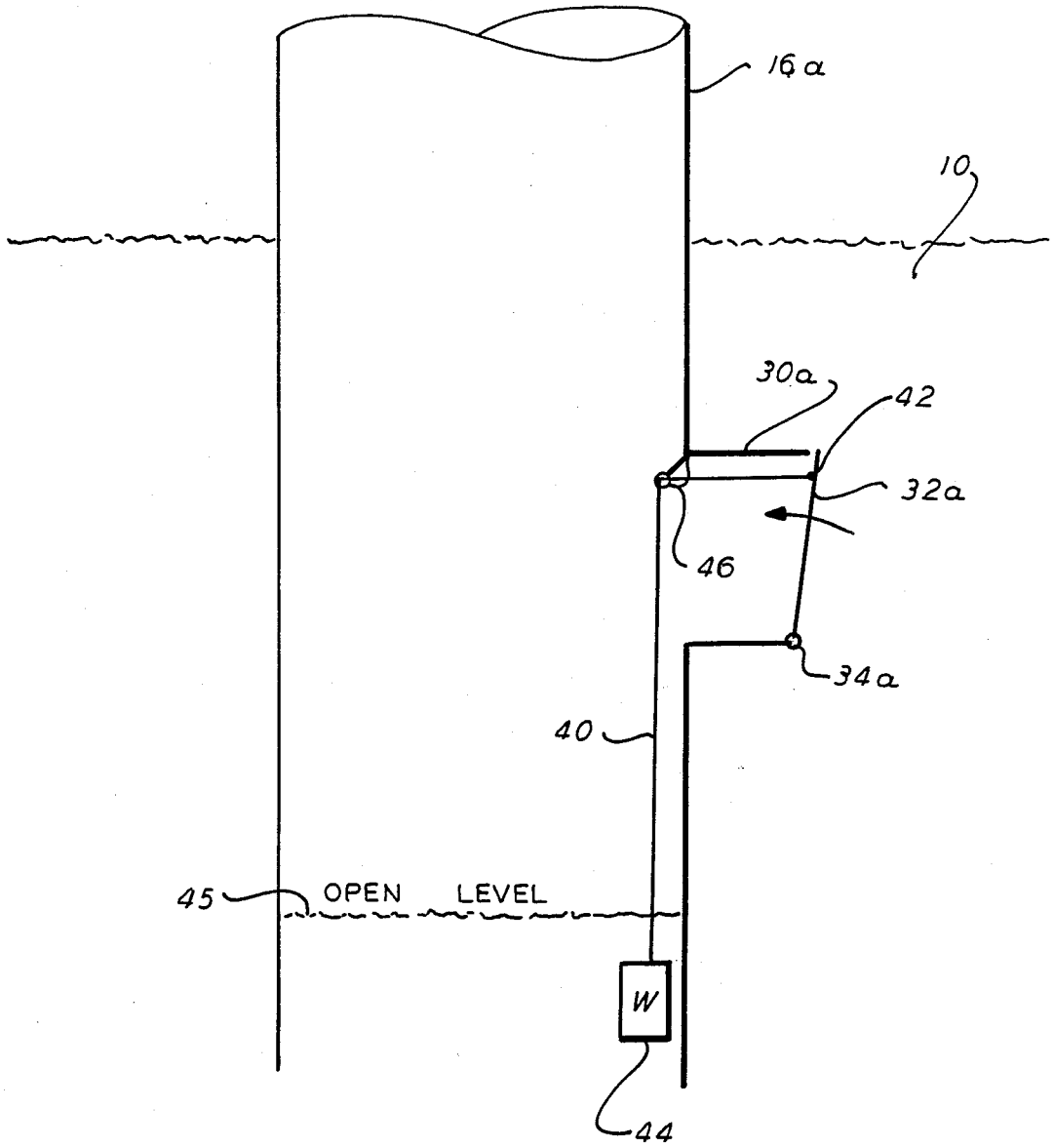
FIG. 2A is a detailed side elevational view similar to FIG. 2, of another embodiment of the invention.

Another embodiment of the biasing system, which employs a weight rather than elastic means, is illustrated in FIG. 2A, wherein parts corresponding to those shown in FIG. 2 have been given the same reference numeral to which an "a" has been added. As seen in FIG. 2*a*, conduit 16*a* has a housing 30*a* provided with a flap 32*a* hinged at its bottom at 34*a*. To bias flap 32*a* in its closed position, a flexible cable 40 is attached at one end 42 to the upper portion of flap 32*a*, and has at its lower end a weight 44. The cable 40 passes about a rotatable idler wheel 46, which is provided near the junction of the conduit 16*a* and the housing 30*a* to guide the line 40 inside conduit 16*a*. Although this system does not positively limit outward movement of flap 32*a*, the normal resistance of the liquid 14 in tank 10 will have the effect of dampening the outward movement of the flap 32*a* so that the weight 44 will be effective to close it again when the excess gas pressure has subsided. The weight 44 is selected in relation to the other components and system geometry, so that the flap valve opens at a gas pressure within conduit 16*a*, as will depress the internal liquid to a predetermined level, e.g. as at "open level" 45.

In operation of the system described and illustrated, the waste gas to be flared will enter through conduit 16. The flap 32 will initially open upon the pressure within 16 depressing the liquid to level 26—which is essentially an equilibrium condition for the system. Gas passing through the flap valve will then pass upwardly through the liquid into the gas flow space 17 defined in the upper portion of drum 10, and exit via outlet conduit 19 into stack 20, from which it will be vented at the upper end 22 after being ignited and diluted with steam, in conventional manner. Increases in gas pressure in conduit 16, tending to further depress the liquid below level 26, will cause increased opening of flap 32 against the restorative force, tending to restore the equilibrium level 26 in the conduit. Therefore, by the provision of flap 32, instead of the gas causing a surge from the bottom of conduit 16 which will pass into flare 20 and create a pulsing action, a relatively smooth non-pulsing or non-surging flow of gas into flare 20 will result. Consequently, the flare in gas will remain ignited, the smoke will remain substantially constant, and the addition of steam can be maintained at the desired minimum quantity. Booming and rumbling noises are thereby eliminated, good public relations are maintained, and energy saved.

It will also be appreciated that since the conduit 16 is open at its lower end 24, any unusually high pressure surge in the conduit, as might be sufficient to overwhelm the capacity of the flap valve, can still escape through end 24, thereby providing a safety measure.

Figure 4:
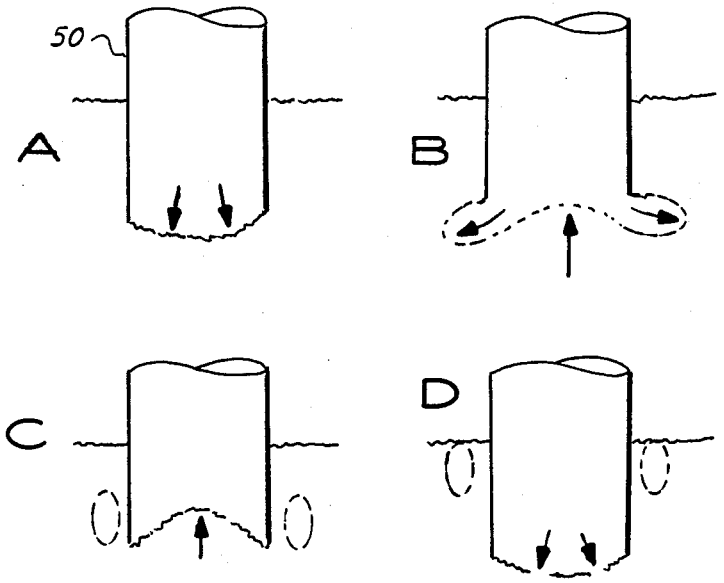
FIG. 4 PRIOR ART
FIG. 4 is a prior art showing, which diagrammatically illustrates the flow of gas from the end of the gas inlet conduit in a conventional flare seal drum.

FIG. 4 illustrates diagrammatically the uneven flow of gas from the inlet conduit in a typical prior art "dip" pipe, not embodying features of the present invention. As seen in "A", the gas pressure in conduit 50 (corresponding functionally to conduit 16 in FIG. 1) depresses the level of liquid in the pipe. As the gas reaches the open end of the conduit, large bubbles of the gas are formed as seen at "B". These bubbles suddenly separate (at "C"), and rise to the surface (at "D"), and thereupon are discharged from the system as surges. The same cycle A through D is then successively repeated to create a pulsing gas flow at the flare stack—with the detrimental effects already discussed. In accordance with the construction of the invention, this action is almost entirely suppressed.

It will, of course, be understood that various changes and modifications may be made in the invention without departing from the scope of the invention as defined in the appended claims; and it is intended, therefore, that all matter contained in the foregoing descriptions, and in the drawings, shall be interpreted as illustrative only and not in a limiting sense.

I claim:

1. In a flare seal system of the type including a flare seal drum containing a body of liquid at a predetermined level and thereby defining an overlying gas flow space in said drum; a waste gas inlet conduit extending vertically into said liquid body and having a wall and an open end beneath the liquid level, whereby said gases discharging from said inlet conduit pass through said liquid body and thereupon enter said drum gas flow space; and an opening from said drum at a point overlying said liquid surface to connect said gas flow space to a flare stack to enable discharge of said gases; the improvement enabling the reduction of gas pulsing from said seal drum, comprising:

an opening in said gas inlet conduit wall at a location spaced from said inlet conduit open end, flap valve means pivotally mounted at the wall of said inlet conduit positioned over said last-named opening, and openable at a point beneath said liquid level; and means to bias said valve to a closed position; the presence of said inlet gas flow acting against said bias to open said valve to enable gas flow into said liquid to enable unimpeded gas flow therethrough.

2. A system in accordance with claim 1, wherein the said biasing means comprises a weight.

3. A system in accordance with claim 1, wherein said flap valve means is mounted in such a position that the opening of same faces upwardly toward the surface of said liquid to enable unimpeded gas flow therethrough.

4. A system in accordance with claim 3, wherein the restoring force of said biasing means increases with the opening of said flap valve.

5. A system in accordance with claim 4, wherein said biasing means comprises a weight movable with the flap portion of said valve means, said weight having a lever arm with respect to the axis of pivot of said flap which increases with the opening of said flap, thereby to create an increasing restoring force as the size of the opening increases.

6. A flare seal system for reducing gas pulsing comprising:

flare seal drum containing a body of liquid at a predetermined level;

a gas inlet conduit extending through the walls of the said drum and protruding vertically into said liquid body and having an open end beneath the liquid level to enable discharge of waste gases therefrom;

an overlying gas space being defined in said drum for receiving the gas flow passing from said conduit and through the said liquid;

a flare stack;

means defining an opening in said drum connecting the overlying gas space in said drum to said flare stack to enable discharge of said gases from said drum;

said inlet conduit having a wall, and an opening in said gas inlet conduit wall at a location spaced from said inlet conduit open end;

flap valve means positioned over said opening on the wall of said inlet conduit at a position beneath said liquid level spaced from the inlet conduit open end; and means biasing said flap valve to a closed position whereby the pressure of inlet gas flow can act against said gas flow space and thereby through said drum and to said stack.

* * * * *